US006809468B1

(12) United States Patent
Pirovic

(10) Patent No.: US 6,809,468 B1
(45) Date of Patent: Oct. 26, 2004

(54) CATHODE WITH DISINTEGRATION SHIELD IN A GAS DISCHARGE LAMP

(75) Inventor: Arpad Pirovic, Woodbridge, CT (US)

(73) Assignee: Light Sources, Inc., Orange, CT (US)

( * ) Notice: Subject to any disclaimer, the term of this patent is extended or adjusted under 35 U.S.C. 154(b) by 0 days.

(21) Appl. No.: 10/316,370

(22) Filed: Dec. 11, 2002

(51) Int. Cl.[7] ..... H01J 1/62; H01J 63/04

(52) U.S. Cl. ..... 313/493; 313/490; 313/580; 313/634

(58) Field of Search ..... 313/493, 490, 313/580, 609, 634

(56) References Cited

U.S. PATENT DOCUMENTS 3,619,697 A * 11/1971 Evans ..... 313/144
5,374,871 A * 12/1994 Johnson ..... 313/546

FOREIGN PATENT DOCUMENTS

WO WO 81/01344 5/1981

* cited by examiner

*Primary Examiner*—Joseph Williams
*Assistant Examiner*—Kevin Quarterman
(74) *Attorney, Agent, or Firm*—Fattibene & Fattibene; Paul A. Fattibene; Arthur T. Fattibene

(57) ABSTRACT

A cathode shield for a gas discharge lamp having a predetermined size hole proportional to the diameter of a cup and the diameter of the glass envelope of the gas discharge lamp. A conductive cup is placed around an electrode or a filament. The cup is covered with an insulator material having a hole therein. The diameter of the hole in the cover has a proportional relationship to the diameter of the envelope of the lamp and the diameter of the cup. The ratio of the diameter of the envelope and the hole in the cover ranges between 3.5 and 4.5. The ratio of the diameter of the cup and the hole in the cover ranges between 2.0 and 3.0. It has been determined that these ratios improve current loads without changing discharge characteristics. Additionally, lower temperature operation and starting is facilitated with increased service life. The cathode shield is particularly applicable to germicidal lamps used in water treatment due to the cooler starting and operating temperatures required.

11 Claims, 3 Drawing Sheets

CATHODE WITH DISINTEGRATION SHIELD IN A GAS DISCHARGE LAMP

FIELD OF THE INVENTION

The present invention relates in general to improving the current load of a gas discharge lamp, and particularly to a predetermined size shield for an electrode or cathode for improving performance.

BACKGROUND OF THE INVENTION

Low pressure gas discharge lamps, such as fluorescent lamps and germicidal lamps, have been known for many years. Gas discharge lamps usually have an envelope or a vessel enclosing electrodes that function as a cathode and anode. Ionized gas between the cathode and anode create an electromagnetic radiation discharge. In a fluorescent lamp, this discharge is converted to visible light. In a germicidal lamp, the ultraviolet radiation is used to disinfect materials such as wastewater.

While cathode shields of different structures have been utilized in the past to limit the loss of emission material from the cathode caused by ion bombardment and vaporization, prior cathode shields have not improved current load without changing discharge characteristics of the lamp. Prior cathode shield structures have increased the service life of a fluorescent lamp and have reduced the blacking of the inside of the lamp. However, these prior cathode shields may also increase the starting voltage of the fluorescent lamp. Therefore, there is a need for a cathode shield for use in a gas discharge lamp that can improve the current load without changing discharge characteristics.

SUMMARY OF THE INVENTION

The present invention comprises a cathode shield for use in a gas discharge lamp that has predetermined openings proportional to the size of the lamp and shield resulting in improved current load without changing discharge characteristics of the gas discharge lamp, as well as improving lamp life. A gas discharge lamp has a quartz envelope or vessel having a predetermined diameter. An electrode placed within the envelope or vessel has a cup shaped shield placed around the electrode or filament. The cup shaped shield has a large opening adjacent the end of the gas discharge lamp. A cover placed on the cup shaped shield has a hole therein. The diameter of the hole in the cover has a proportional relationship to the diameter of the envelope or vessel and the diameter of the cup shaped shield. Specifically, the ratio of the diameter of the envelope or vessel to the diameter of the hole in the cover is between 3.5 and 4.5, and the ratio of the diameter of the cup to the diameter of the hole in the cover is between 2.0 and 3.0. These proportional relationships have been found to reduce the cross sectional area of the arc at the anode or electrode, thereby increasing ion and electron current density and effectively cooling the anode. This allows for increased current load. The temperature cooling effect of the present invention also decreases the evaporation rate of cathode emission material, resulting in less consumption of emission material and longer cathode life.

Accordingly, it is an object of the present invention to improve current load without changing discharge characteristics of a gas discharge lamp.

It is a further object of the present invention to improve lamp life.

It is an advantage of the present invention that heat is dissipated.

It is another advantage of the present invention that lower temperature operation may be obtained and anode fall is reduced.

It is a feature of the present invention that a hole in a cover of a shield is sized in proportion to the lamp envelope and cup shaped shield.

It is a further feature of the present invention that a hole is placed in the cup shaped shield opposite the cover so that amalgam placed on the stem of the lamp becomes accessible.

These and other objects, advantages, and features will become more readily apparent in view of the following detailed description.

DETAILED DESCRIPTION OF THE PREFERRED EMBODIMENTS

Figure 1:
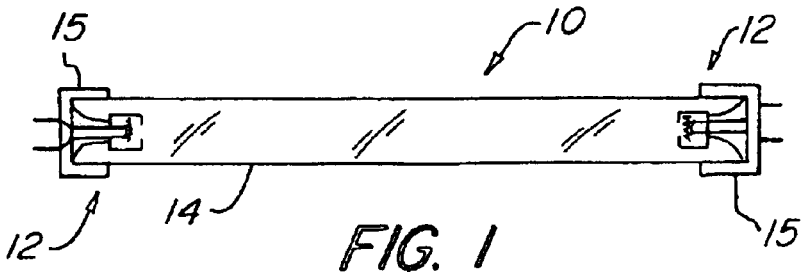
FIG. 1 schematically illustrates a gas discharge lamp.

FIG. 1 schematically illustrates a gas discharge lamp 10. The gas discharge lamp 10 comprises electrode assemblies 12 and end caps 15 on either end of a cylindrical quartz envelope or vessel 14. The gas discharge lamp 10 may be any low pressure gas discharge lamp, such as a germicidal lamp or a fluorescent lamp.

Figure 2:
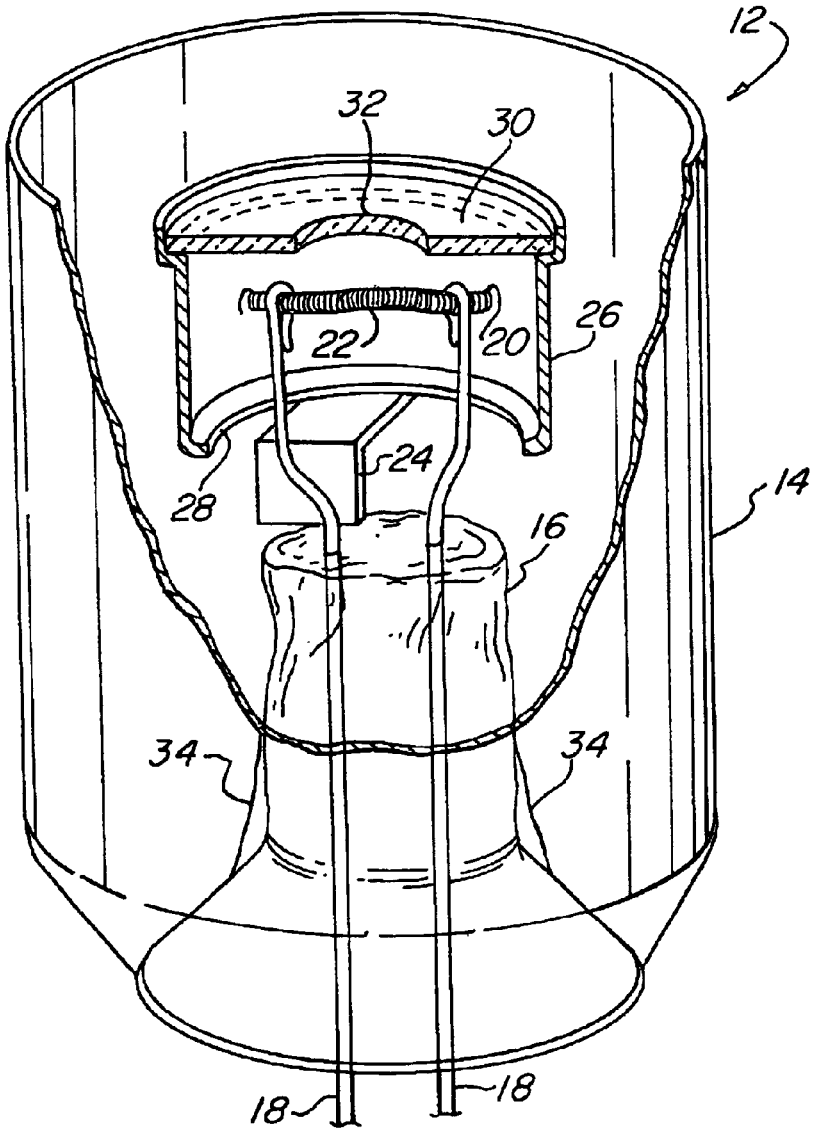
FIG. 2 is a partial cross section illustrating an electrode assembly of one end of a gas discharge lamp.

FIG. 2 illustrates an electrode assembly 12 from one end of the gas discharge lamp 10 illustrated in FIG. 1. Placed within the quartz envelope or vessel 14 is a stem 16. The stem 16 is made of the same material as the glass envelope 14 and may be formed within the glass envelope or vessel 14 or pressed from the glass envelope or vessel 14. Formed within the stem 16 are wire leads 18. The leads 18 support a filament 20, which functions as a cathode or anode for the gas discharge lamp. The filament 20 has an emissive coating 22 thereon. Formed around the filament 20 is a cup shaped shield 26. The cup or shield 26 is attached to one of the leads 18 with a bracket 24. The cup shaped shield 26 has a relatively large bottom hole 28 formed therein adjacent the stem 16. On the stem 16 may be placed amalgam 34. The bottom hole 28 in the cup or shield 26 should be of sufficient size so as to make the amalgam 34 accessible. The cup shaped shield 26 is preferably made of a conductive material. The cup or shield 26 is illustrated as being attached to lead 18. If the bracket 24 is conductive, the cup or shield 26 is considered live. If the bracket 24 is an insulator or if the bracket 24 is connected to the stem 16 and not the lead 18, the cup or shield is considered to be dead or is not electrically connected to the lead 18.

Covering the cup or shield 26 is cover 30. Within cover 30 is a hole 32. The cover 30 is preferably made of a non-conducting material, such as mica, having a thickness from between 0.003 and 0.005 inches.

Figure 3:
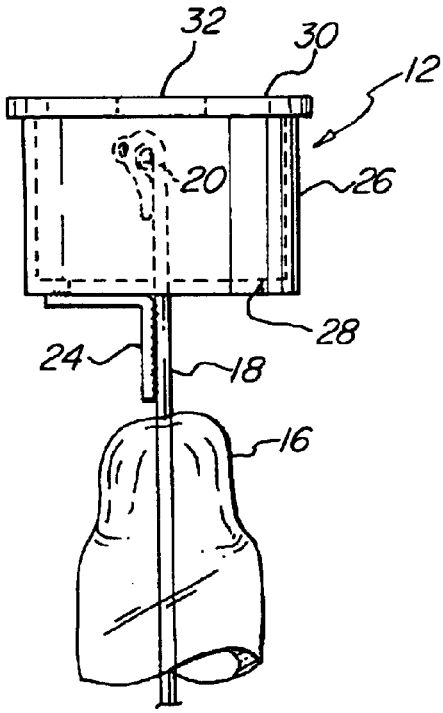
FIG. 3 is an elevational view illustrating the electrode assembly

FIG. 3 illustrates the electrode assembly 12. The filament or cathode 20 held by the lead 18 is shielded by cup shaped shield 26 and cover 30. However, adjacent the electrode or filament 20 is hole 32. The hole 32 has a predetermined diameter. The predetermined diameter of hole 32 has a relationship with the diameter of the cup shaped shield 26 and the diameter of the envelope or vessel 14, illustrated in FIGS. 1 and 2. In this embodiment the lead 18 is attached to the cup shaped shield 26 by bracket 24. Therefore, the electrode is considered live because it is electrically connected to the lead 18.

Figure 4:
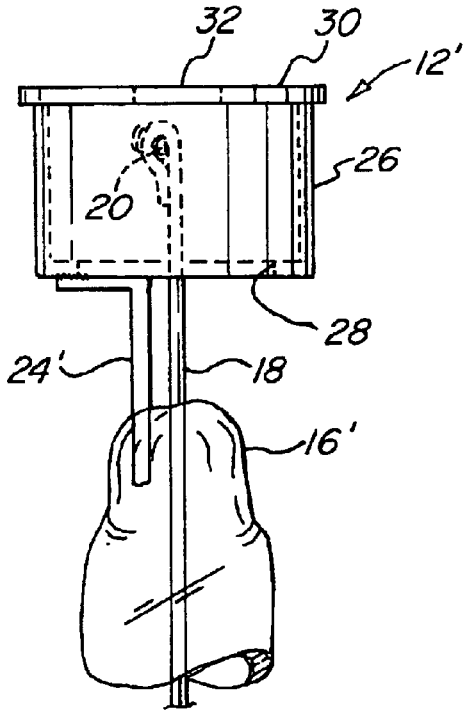
FIG. 4 is an elevational view illustrating another embodiment of an electrode assembly.

FIG. 4 illustrates another electrode assembly 12'. In the electrode assembly 12' the cup shaped shield 26 is held by bracket 24' which is placed within stem 16'. In this embodiment the electrode is considered dead because it is not electrically connected to the lead 18.

Figure 5:
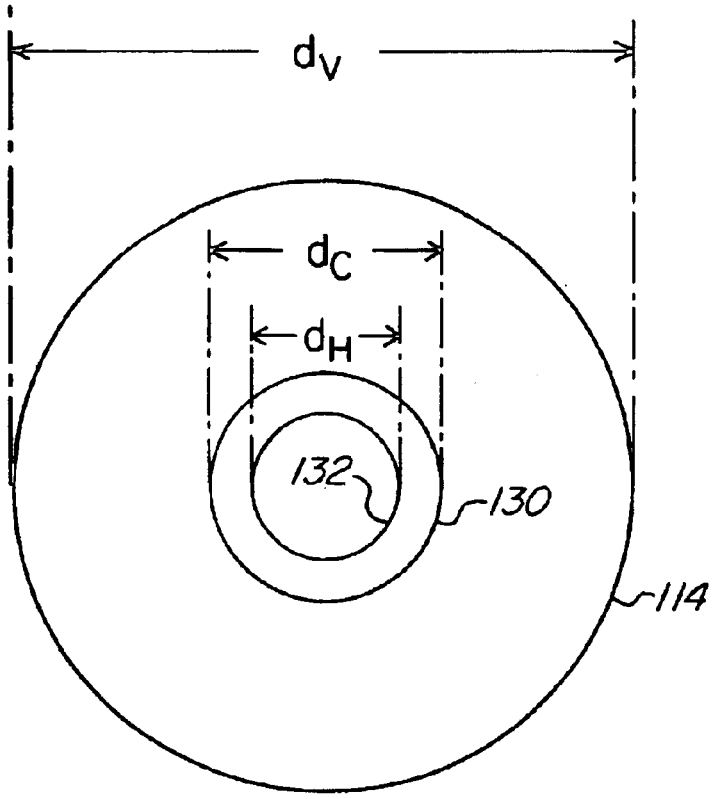
FIG. 5 schematically illustrates the diameters in the shield structure used in the proportional relationships.

FIG. 5 schematically, illustrates the different diameters of the envelope, cup shaped shield, and the hole in the cover used in the gas discharge lamp. Element 114 represents the inside of the envelope or vessel and has a diameter $d_V$. Element 130 represents the cup shaped shield and has a diameter $d_C$. Element 132 represents the hole in the cover and has a diameter $d_H$.

It has been discovered that improved current load is obtained without changing the discharge characteristics of the lamp if specific or predetermined proportional relationships are maintained between the different diameters $d_V$, $d_C$ and $d_H$. The preferred proportional relationship is particularly advantageous for providing low temperature operation and starting of a gas discharge lamp. The present invention is particularly applicable to lamps used in cold or cooler weather, or that are submerged in a relatively cool fluid such as use in germicidal applications. For example, germicidal lamps are often submerged in wastewater to disinfect the wastewater prior to discharge. Usually, this wastewater is relatively cool, and therefore the lamp must operate in a relatively cool environment. It has been determined that improved service life and low temperature operating and starting is achieved when the ratio of $d_V$ to $d_H$ ranges between 3.5 and 4.5 and the ratio of $d_C$ to $d_H$ ranges between 2.0 and 3.0.

For example, the table below illustrates preferred dimensions for the different diameters.

| $d_H$ | $d_C$ | $d_V$ | $d_V/d_H$ | $d_C/d_H$ |
|---|---|---|---|---|
| 0.375 | 0.875 | 1.500 | 4.00 | 2.33 |
| 0.250 | 0.750 | 1.000 | 4.00 | 3.00 |
| 0.188 | 0.500 | 0.750 | 3.98 | 2.65 |
| 0.156 | 0.138 | 0.625 | 4.01 | 2.80 |

Where, $d_H$=the diameter of the hole in the cover;

$d_C$=the diameter of the cup shaped shield; and $d_V$=the diameter of the envelope or vessel.

The above units of the different diameters are expressed in inches, but any units may be used as it is the ratio that is of interest in determining the proportional relationships of the diameters.

Accordingly, the present invention is a new cathode design with an improved disintegration shield. This shield and cover reduce the cross section area of the arc at the anode, thereby increasing ion and electron current density and effectively cooling the anode. The temperature controlling effect of this electrode design decreases the evaporation rate of cathode emission material. This results in less consumption of emission material and longer cathode life. The present invention helps to dissipate heat and dissipates an electron cloud around the filament to help cooling. Increased current loads may be achieved without changing discharge characteristics. Additionally, lower temperature operations may be maintained with reduced anode fall. This conserves emission material placed on the filament and increases service life. Additionally, amalgam placed on the stem may be better accessed. Therefore, the present invention, in providing specific proportional relationships between the different diameters of the electrode assembly greatly improves lamp operation.

Figure 6:
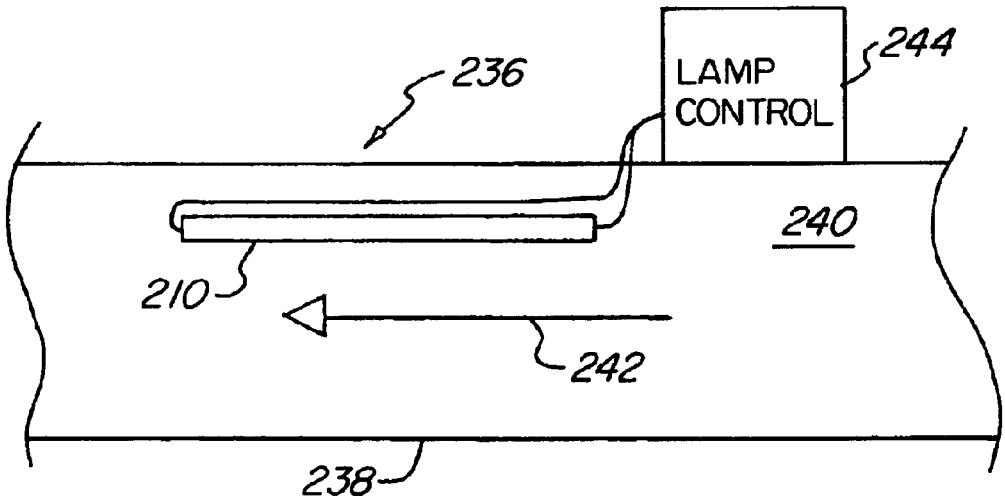
FIG. 6 schematically illustrates showing a germicidal water treatment system embodiment of the present invention.

FIG. 6 schematically illustrates a germicidal application for disinfecting contaminated water or the treatment of wastewater. A water treatment system 236 comprises a conduit 238 containing water 240 for germicidal treatment. The water 240 has a direction of flow represented by arrow 242. Ultraviolet germicidal lamp 210 has an electrode construction as illustrated in FIGS. 2–4 and is controlled by lamp control 244. The germicidal lamp 210 is submerged in the water 240 being treated. The electrode construction illustrated in FIGS. 2–4 permits the germicidal lamp 201 to operate at lower operating temperatures with improved service life. This is beneficial due to the lower operation temperatures typically encountered as a result of the temperature of the water 240 being treated. The germicidal lamp 210 has improved starting and longer service life.

While the preferred embodiments have been illustrated and described, it will be appreciated by those skilled in the art that various modifications may be made without departing from the spirit and scope of this invention.

What is claimed is:

1. A gas discharge lamp comprising:

an envelope having a first diameter;

a filament placed within said envelope;

a cup shaped shield having a second diameter and a bottom round hole placed around said filament;

a cover having a hole with a third diameter covering said cup shaped shield opposite the bottom hole; and wherein the third diameter of the hole in said cover has a predetermined size forming a first proportion relative to the second diameter of said cup shaped shield and a second proportion relative to the first diameter of said envelope so that a cross section area of an arc is reduced increasing ion and current density, and wherein the first proportion of the second diameter to the third diameter is between 2.0 and 3.0; and the second proportion of the first diameter to the third diameter is between 3.5 and 4.5, whereby current load is improved without changing discharge characteristics.

2. A gas discharge lamp as in claim 1 wherein:

the gas discharge lamp is a germicidal lamp.

3. A gas discharge lamp as in claim 1 further comprising:

amalgam placed adjacent the bottom hole; and wherein the bottom hole has a size adapted to access said amalgam.

4. A gas discharge lamp comprising:

an envelope having a first diameter;

a stem sealing an end of said envelope;

a lead wire placed within said stem;

a filament placed on said lead wire;

a cup having a second diameter placed around said filament, said cup having a bottom hole therein over said stem;

a cover having a hole with a third diameter covering said cup opposite the bottom hole; and wherein the ratio of the first diameter and the third diameter ranges between 3.5 and 4.5 and the ratio of the second diameter and the third diameter ranges between 2.0 and 3.0, whereby improved current load and low temperature operation is obtained without changing discharge characteristics of the gas discharge lamp.

5. A gas discharge lamp as in claim 4 wherein: said cup is a conductor.

6. A gas discharge lamp as in claim 4 wherein: said cover is an insulator.

7. A gas discharge lamp as in claim 4 wherein: said cup is electrically connected to said lead wire.

8. A gas discharge lamp as in claim 4 wherein: said cup is electrically insulated from said lead wire.

9. A germicidal lamp for use in water treatment comprising:

an envelope having a first diameter;

a stem sealing an end of said envelope;

a lead wire placed within said stem;

a filament placed on said lead wire;

a cup having a second diameter placed around said filament, said cup having a bottom hole therein over said stem;

a cover having a hole with a third diameter covering said cup opposite the bottom hole;

wherein the ratio of the first diameter and the third diameter ranges between 3.5 and 4.5 and the ratio of the second diameter and the third diameter ranges between 2.0 and 3.0;

a conduit containing water for germicidal treatment, said envelope submerged in the water; and a lamp control coupled to said lead wire, whereby improved current load and low temperature operation is obtained without changing discharge characteristics of the gas discharge lamp.

10. A germicidal lamp for use in water treatment as in claim 9 further comprising:

amalgam placed adjacent the bottom hole; and wherein the bottom hole has a size adapted to access said amalgam.

11. A method of disinfecting contaminated water and increasing current load in a gas discharge lamp operated at relatively low temperature having an envelope of a first diameter comprising:

placing a cup having a second diameter around a filament of the gas discharge lamp;

covering the cup with a cover having a hole with a third diameter;

wherein the ratio of the first diameter and the third diameter ranges between 3.5 and 4.5 and the ratio of the second diameter and the third diameter ranges between 2.0 and 3.0; and submerging the gas discharge lamp in the contaminated water, whereby improved current load and low temperature operation is obtained without changing discharge characteristics of the gas discharge lamp.

* * * * *